US009889455B2

(12) United States Patent
Wilson et al.

(10) Patent No.: US 9,889,455 B2
(45) Date of Patent: Feb. 13, 2018

(54) PARTICULATE SPRAYER

(75) Inventors: Tracie L. C. Wilson, Westminster, MD (US); David Richard Stonehouse, Cambridge (GB); Craig Harvey Nelson, Baldock (GB); Carys Eleri Lee, Cambridge (GB); Paul Nigel Marsh, Royston (GB); Benjamin Erland Impey, Haslingfield (GB)

(73) Assignee: MCCORMICK & COMPANY, INCORPORATED, Sparks, MD (US)

( * ) Notice: Subject to any disclaimer, the term of this patent is extended or adjusted under 35 U.S.C. 154(b) by 336 days.

(21) Appl. No.: 13/599,872

(22) Filed: Aug. 30, 2012

(65) Prior Publication Data

US 2013/0056547 A1 Mar. 7, 2013

Related U.S. Application Data

(60) Provisional application No. 61/529,025, filed on Aug. 30, 2011.

(51) Int. Cl.

| | |
|---|---|
| ***A62C 5/02*** | (2006.01) |
| ***B05B 7/24*** | (2006.01) |
| ***B05B 7/14*** | (2006.01) |
| ***B05B 11/06*** | (2006.01) |
| ***B65D 83/42*** | (2006.01) |
| ***B65D 83/60*** | (2006.01) |

(52) U.S. Cl.

CPC ..... *B05B 7/2421* (2013.01); *B05B 7/1481* (2013.01); *B05B 11/062* (2013.01); *B65D 83/42* (2013.01); *B65D 83/60* (2013.01); *B05B 7/2429* (2013.01)

(58) Field of Classification Search

CPC ... B05B 11/062; B05B 7/2421; B05B 7/2429; B05B 7/1481; B65D 83/60; B65D 83/42

USPC ..... 239/8

See application file for complete search history.

(56) References Cited

U.S. PATENT DOCUMENTS

| | | | | |
|---|---|---|---|---|
| 436,580 | A | 9/1890 | Hoell | |
| 1,919,153 | A | 7/1933 | Andrews | |
| 2,950,564 | A * | 8/1960 | Bonine | 222/631 |
| 3,085,752 | A * | 4/1963 | Drell | B05B 7/2421 239/303 |

(Continued)

FOREIGN PATENT DOCUMENTS

| | | |
|---|---|---|
| GB | 26013 | 6/1908 |
| WO | WO 2006/058433 | 6/2006 |

OTHER PUBLICATIONS

International Search Report and Written Opinion dated Nov. 16, 2012 in PCT/US2012/053027 filed Aug. 30, 2012.

Australian Office Action dated Mar. 31, 2016 and issued in Australian Application No. 2012301925 (3 pages).

(Continued)

*Primary Examiner* — Arthur O Hall
*Assistant Examiner* — Joel Zhou
(74) *Attorney, Agent, or Firm* — Greenblum & Bernstein, P.L.C.

(57) ABSTRACT

A particulate sprayer includes a gas reservoir to hold a gas, a liquid reservoir to hold a product, and a low pressure section including an exit opening connected to the liquid reservoir. The product includes a liquid and solid particles. The low pressure section transports gas released from the gas reservoir over the exit opening. The product is drawn, pushed, or drawn and pushed from the exit opening into the transported gas to create a spray of the product to be sprayed from the particulate sprayer.

18 Claims, 7 Drawing Sheets

(56) References Cited

U.S. PATENT DOCUMENTS

| | | | | | |
|---|---|---|---|---|---|
| 3,454,228 | A | | 7/1969 | Mossop | |
| 3,638,838 | A | * | 2/1972 | Marraffino | B65D 83/685 222/129 |
| 3,675,824 | A | | 7/1972 | Hein | |
| 3,704,811 | A | * | 12/1972 | Harden, Jr. | B05B 7/2427 222/4 |
| 3,733,031 | A | | 5/1973 | Marand | |
| 3,856,185 | A | * | 12/1974 | Riccio | A61M 11/06 222/635 |
| 3,921,857 | A | * | 11/1975 | Riccio | B05B 11/06 222/145.5 |
| 4,941,599 | A | * | 7/1990 | Reinertz | B05B 11/062 222/401 |
| 4,993,639 | A | | 2/1991 | Hata | |
| 5,568,884 | A | * | 10/1996 | Bruna | 222/189.09 |
| 5,582,718 | A | | 12/1996 | Sobczak | |
| 5,865,350 | A | | 2/1999 | Losenno | |
| 2008/0001002 | A1 | * | 1/2008 | Garon | B05B 7/2408 239/67 |
| 2011/0163183 | A1 | * | 7/2011 | Ko | B05B 11/06 239/302 |

OTHER PUBLICATIONS

Australian Office Action dated Oct. 19, 2016 and issued in Australian Application No. 2012301925 (5 pages).

Mexican Office Action dated Apr. 25, 2017 and issued in Mexican Application No. MX/a/2014/002505.

Extended Search Report, dated May 4, 2015 in European Application No. EP 12 82 6959.4; 5 Pages.

* cited by examiner

PARTICULATE SPRAYER

CROSS-REFERENCE TO RELATED APPLICATIONS

The present application claims the benefit of priority under 35 U.S.C. §119(e) to U.S. Application No. 61/529,025, filed Aug. 30, 2011, the entire contents of which are incorporated by reference herein.

BACKGROUND

The description herein relates to a particulate sprayer for spraying a product containing a liquid and particles dispersed in the liquid.

Conventional sprayers can spray a liquid product. Such sprayers can use a pump or compressed gas to create the pressure needed to expel the liquid from the sprayer. Such sprayers also typically include a filter or orifice or nozzle to divide the liquid into smaller drops to create a spray.

Accordingly, if the conventional sprayers were used to attempt to spray a liquid product that also contained a solid material, then the solid material would clog the filter or nozzle or orifice, rendering the sprayers inoperable.

SUMMARY

A particulate sprayer includes a gas reservoir to hold a gas, a liquid reservoir to hold a product, and a low pressure or high velocity or Venturi or mixing section (hereinafter "low pressure section") including an exit opening connecting it to the liquid reservoir. The product includes a liquid and a solid. The low pressure section can transport gas released from the gas reservoir over or across the exit opening to create a spray of the product to be sprayed from the particulate sprayer. The gas can draw liquid up from the liquid reservoir or the liquid could be pushed up, with the gas creating the spray from the liquid pushed into its path, or the liquid can be both drawn and pushed up into the path of the gas.

A method of spraying a product includes pressurizing a gas stored in a gas reservoir, storing a product including a liquid and a solid in a liquid reservoir, releasing the gas from the gas reservoir into a low pressure section, and routing the gas in the low pressure section over or across an exit opening in the liquid reservoir to help draw the product out of the liquid reservoir into the gas to create a spray of the product. Alternatively or in addition to the drawing of the liquid, the liquid can be pushed up into the path of the gas. The spray is created by the interaction of the high velocity gas and the liquid as it emerges from the feed orifice and/or in the tube following the feed orifice and/or as it exits the device into free air and/or in the free air having exited the device.

BRIEF DESCRIPTION OF THE DRAWINGS

A more complete appreciation of the depicted embodiments and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
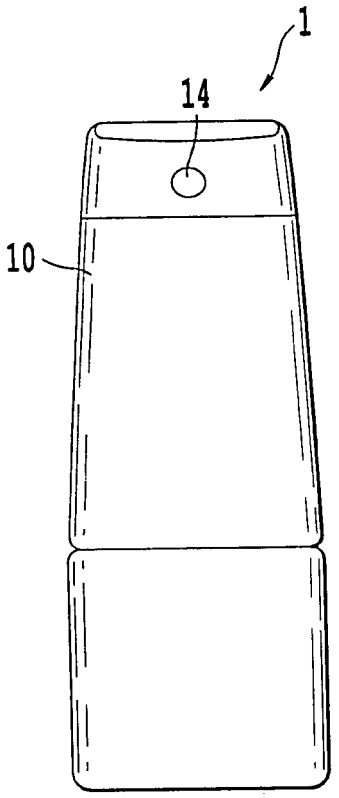
FIGS. 1A and 1B depict an exemplary particulate sprayer.

Referring now to the drawings, wherein like reference numerals designate identical or corresponding parts throughout the several views.

Figure 1B:
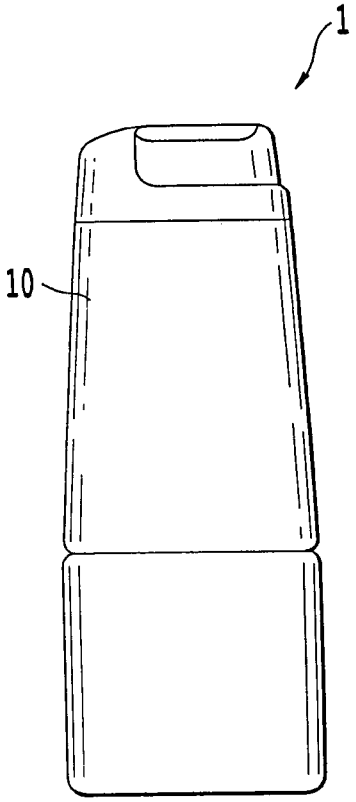

An exemplary embodiment of the particulate sprayer 1 is shown in FIGS. 1A and 1B. The particulate sprayer 1 includes a label 10 that has an aperture 14 through which droplets are sprayed. Alternatively, the aperture 14 can be positioned on another part of the particulate sprayer 1 that is not covered by the label 10.

Figure 2:
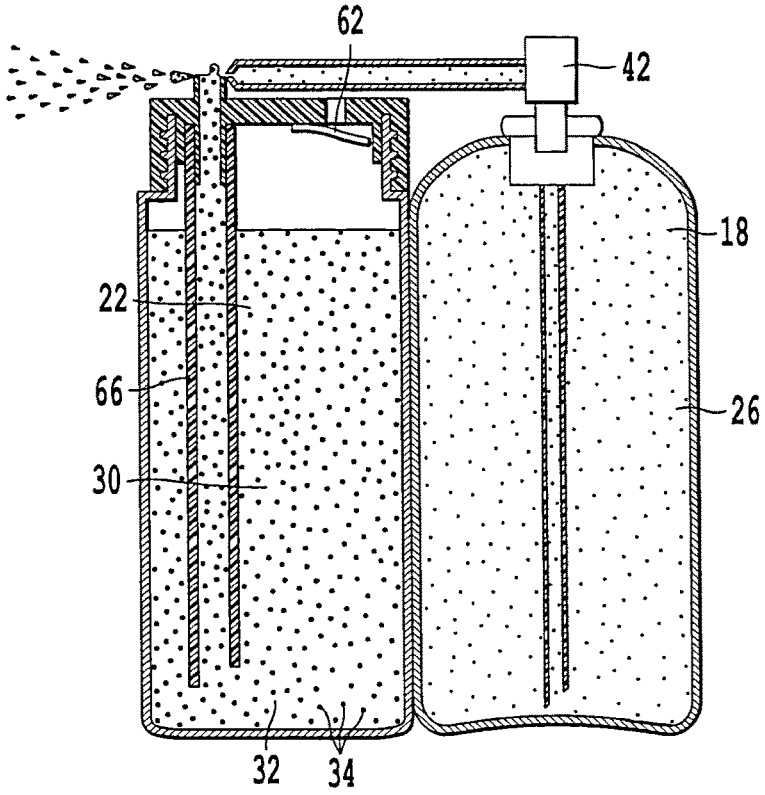
FIG. 2 depicts a sectional view of an exemplary particulate sprayer.

Beneath the label 10 are a gas reservoir 18 and a liquid reservoir 22, as shown in FIG. 2. The gas reservoir 18 includes gas 26, such as air, to expel droplets of a product 30 held in the liquid reservoir 22 from the particulate sprayer 1. Alternatively, the gas could be nitrogen, argon, carbon dioxide, hydrocarbons, nitrous oxide, HFA, or another suitable gas. The gas reservoir 18 could also hold a liquefied gas held in equilibrium with gas above it, like an aerosol propellant, or reactants which form a gas. Hereinafter the term "gas" is used for simplicity. The gas 26 can be packed under pressure such that pressing a button 42 releases gas from the reservoir 18.

Figure 4:
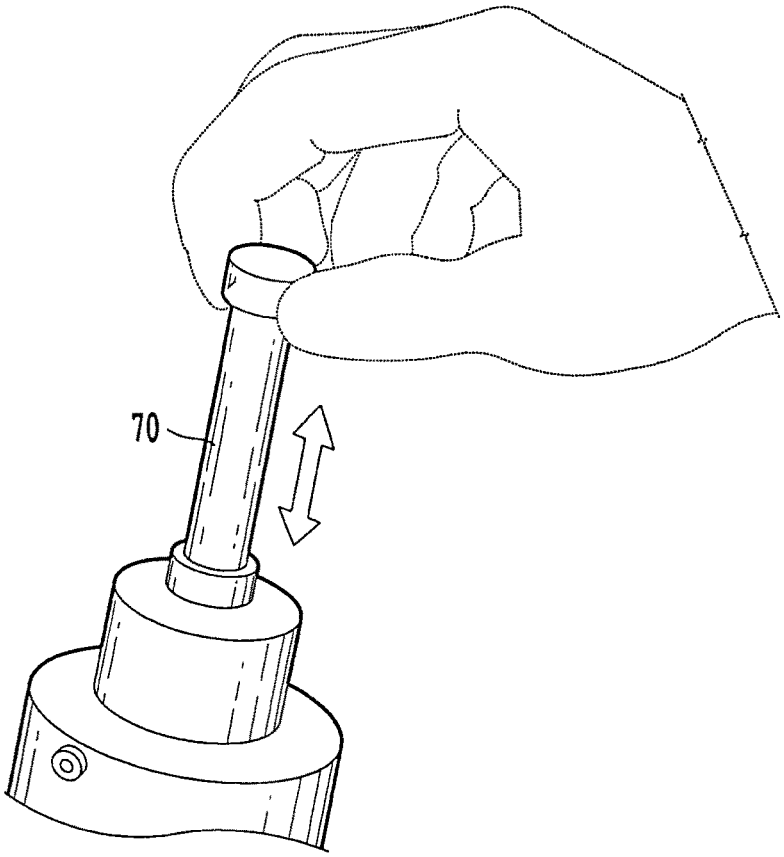
FIG. 4 depicts an exemplary particulate sprayer in use.
Figure 5:
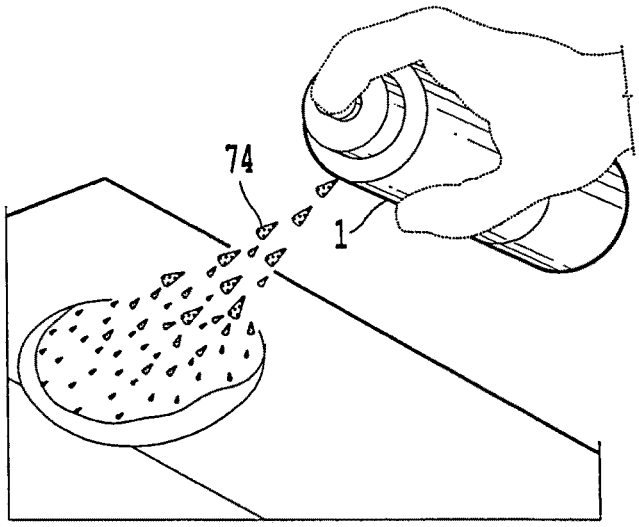
FIG. 5 depicts an exemplary particulate sprayer in use.

Alternatively, the gas reservoir 18 can include a pump 70 which may be single or double acting, as shown in FIG. 4, which a user pumps up to build up the pressure in the gas reservoir 18. In an exemplary embodiment, a user pumps the pump 70 six times to build sufficient pressure to generate spray for two seconds. Alternatively, in order to generate sufficient pressure, a compressor could be used, with or without an accumulator, or a solid such as carbon dioxide could sublimate.

The product 30 includes liquid 32 and particles of one or more solids 34 suspended therein. The term solid as used herein also includes solid-like particles such as a gel. Such gels might be from a natural food product or as part of a formulation, or to add texture. Further, the solid particles can be permanently suspended in the liquid or can be temporarily suspended such that the particulate sprayer 1 needs to be shaken before use to mix the particles and liquid. The liquid reservoir 22 includes a dip tube 66 through which the product 30 including the solid particles 34 travels. As discussed further below, the product 30 could be drawn, pushed, or pushed and drawn and/or flow through the dip tube 66 by the same gas supply or another force.

Figure 3:
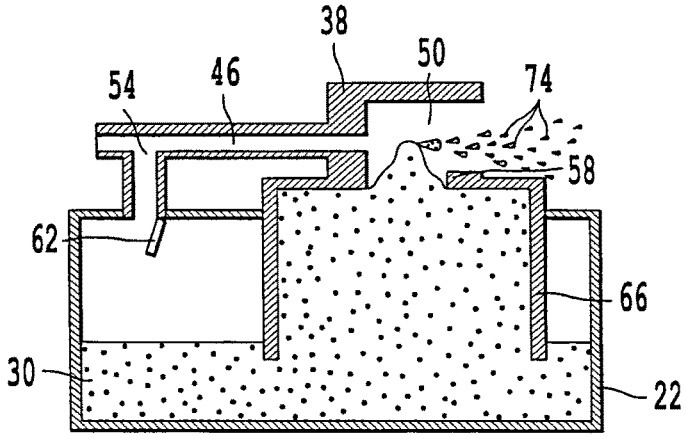
FIG. 3 depicts a sectional view of a portion of an exemplary particulate sprayer.

The particulate sprayer 1 also includes a low pressure section 38, as shown in FIG. 3. In an exemplary embodiment, the low pressure section 38 is not a classic Venturi in that reduction in pressure is not the result of a gas stream flowing through a constricted section of pipe. Instead, the low pressure section 38 uses the effect of relatively high speed gas flowing over the top of the dip tube 66 to create a pressure drop and draw the product 30 into the gas stream. The tube cross section on the reservoir side helps to control the air flow and the larger cross section on the outlet helps to prevent the particulates from clogging an exit opening 58. In an alternative embodiment, the low pressure section 38 could have a constricted section of pipe to form the classic Venturi. In this or an alternative embodiment a restriction in the first pathway 46 or as it enters the second pathway 50 could be used to control or choke the flow of air as it exits.

The restriction is an orifice or narrowing of the tube which controls the flowrate from the gas reservoir 18 into the low pressure section 38. In an exemplary embodiment, the restriction is 1.2 mm in diameter. Other diameters could also be used to achieve the desired flowrate. The restriction creates a negative pressure in the low pressure section 38 by flowing the air through it. The restriction can be a classic Venturi design with smooth walls and gradual reduction and increase in diameter or simply a reduction in the diameter of the pipe where the restriction is located. In addition to using the restriction to create a negative pressure, an orifice can also be positioned before the low pressure section 38 to control the flowrate entering the low pressure section 38. This orifice can be a separate orifice (or narrowing of the tube) or can be the same orifice which controls the flow and provides high velocity air to create a negative pressure.

The low pressure section 38 can be positioned at the top of the labeling 10, above the gas reservoir 18 and the liquid reservoir 22. Alternatively, the low pressure section 38 can be positioned below the gas reservoir 18 and the liquid reservoir 22. Other positions for the low pressure section 38 relative to the reservoirs 18 and 22 are also envisioned. For example, the low pressure section 38 could be positioned above the liquid reservoir 22 with the gas reservoir 18 above it. Or, the low pressure section 38 could be positioned above the gas reservoir 18 with the liquid reservoir 22 above it.

In an exemplary embodiment, the low pressure section 38 includes a first pathway 46, which has a diameter, and a second pathway 50, which has a diameter that is larger than the diameter of the first pathway 46. Alternatively, the diameter of the first pathway 46 can be the same size or larger than the diameter of the second pathway 50. Further, the pathways 46 and 50 can be round, square, rectangular, or another suitable shape.

An exemplary operation of the particulate sprayer 1 will now be described.

A user who wishes to spray particulate from the particulate sprayer 1 pushes the button 42 on top of the labeling 10. Alternatively, in an embodiment in which a pump 70 is used, the user first creates a pressure in the gas reservoir 18 by pumping the pump 70, and then pushes the button 42. Pushing the button 42 releases gas 26 held in the gas reservoir 18.

The released gas 26 travels down the first pathway 46 of the low pressure section 38. Once a sufficient pressure is built up in the first pathway 46, for example 0.3-0.5 bar PSI, the pressure opens a one-way valve 62 in the liquid reservoir 22 and a portion of the released gas 26 traveling down the first pathway 46 enters the liquid reservoir 22 via an entrance hole 54 in the liquid reservoir 22. This diverted gas entering the liquid reservoir 22 creates a pressurized head to help maintain the height of the product 30 in the dip tube 66. Alternatively, with a greater pressure differential, the pressurized head can push the product 30 up the dip tube 66. Alternatively, the pressurized head created by the diverted gas can be great enough to push the product out of the exit opening 58 at the top of the dip tube 66 and into the gas flowing from the first pathway 46.

The remainder of the released gas 26 exits the first pathway 46 into the second pathway 50. The second pathway 50 includes the exit opening 58 at the top of the dip tube 66 in the liquid reservoir 22. Alternatively, a separate nozzle or restriction that the product must pass through may be positioned between the exit opening at the top of the dip tube and the second pathway 50.

The air traveling from the first pathway 46 to the second pathway 50 creates a lower pressure over the exit opening 58 whereby the product 30 at the top of the exit opening 58 is sucked up into the air stream and broken up into droplets to create a spray 74 of the product 30 including the solid particles 34. The spray of droplets is then expelled from the particulate sprayer 1 via the aperture 14. Some of the droplets or additional droplets may be formed as the product exits the aperture 14 and the droplets split in the air. Additionally, the spray can be mixed in an extended mixing cavity located after the exit opening 58 to improve the quality of the spray. Further, a director cone can be positioned at the end of the nozzle to help control the pattern and direction of the spray.

Thus, the product 30 is pushed out of the exit opening 58 and is expelled from the particulate sprayer 1 by the flow of the gas from the gas reservoir. Alternatively, the exit opening 58 could include multiple exits and multiple gas pulses of the gas from the gas reservoir 18 can be used to remove pulsing of the spray.

In preferred embodiments, the particulate sprayer 1 can spray the droplets from three to thirty inches and can have a spray pattern that is one to eighteen inches wide. Alternative spray lengths and patterns can also be achieved.

An alternative exemplary embodiment of the particulate sprayer 1 includes a valve in the first pathway 46 that can be closed to force air into the liquid reservoir 22 to pressurize the liquid reservoir 22 until a fixed volume of the product 30 is displaced into an intermediate chamber below the exit opening 58. Once the fixed volume of the product is in the intermediate chamber, the closed valve in the first pathway 46 is opened and the product 30 is drawn out of the intermediate chamber by a Venturi or pressure drop over the exit opening 58. Such a valve can be included in the first pathway 46 even if an intermediate chamber is not used.

Thus, the valve can be used to control the gas pressure or gas volume entering the liquid reservoir based on the volume or height of the liquid in the liquid reservoir. Alternatively, the valve can be used to control the gas flow in the low pressure or high velocity section based on the volume or height of the liquid in the liquid reservoir.

Another alternative exemplary embodiment of the particulate sprayer 1 does not divert gas into the liquid reservoir 22. Instead, the gas moves sufficiently fast over the opening 58 at the top of the dip tube 66 in the liquid reservoir 22 to draw the product out into the gas stream to create the spray.

Thus, the particulate sprayer 1 does not require a filter, nozzle or orifice or other mechanism at or near the aperture 14 to create the spray 74 from the product expelled from the exit opening 58. Accordingly, the sprayer 1 can spray a product 30 including both liquid and solid particles without becoming clogged.

Of course, a person of ordinary skill in the art would understand that the particulate sprayer could include a filter at or near the aperture 14. Such a filter could be used to remove particles above a desired size from the spray. Likewise a filter or restriction could be included at the base of the dip tube to prevent particles or materials above a desired size from entering the spray.

In the embodiment using gas stored under pressure, when the button 42 is released, the gas reservoir 18 closes, causing a drop in pressure in the low pressure section 38. In the embodiment using the pump 70, the pressure that is built up from the pumping declines so that the pressure difference between the gas reservoir 18 and the low pressure section 38 decreases.

Once the pressure in the first pathway 46 falls below a predetermined amount required to keep the one-way valve 62 open, the valve 62 closes such that the air no longer enters the liquid reservoir 22 to help push the product 30 up the dip tube 66. At the same time, the decrease in air flow over the exit opening 58 is no longer sufficient to draw the product 30 up the dip tube 66 through the exit opening 58. Thus, the spray 74 from the particulate sprayer 1 stops.

An exemplary embodiment of a particulate sprayer 1 for use with a product 30 having a viscosity of 3,000-7,000 cP at approximately 25° C. will now be described.

The gas 26 from the gas reservoir 18 having a volume of 250-500 ml is pressurized to approximately 1-4 bar and released to move through the first pathway 46, which has a 1.5 mm diameter, at a rate of 0.1 liters per second. This creates a maximum pressure of 0.5 bar in the first pathway 46. Thus, the one-way valve 62 is opened by the pressure, thereby diverting some of the air, on the order of 0%-10%, into the liquid reservoir 22 having a volume of 250-500 ml through the entrance hole 54.

The non-diverted air passes from the first pathway 46 into the second pathway 50, which has a diameter of 6 mm, and over the exit opening 58, which has a diameter of 8 mm, to create a negative pressure to draw the product 30 up from the dip tube 66, which has a diameter of 12 mm, through the exit opening 58, which has a diameter of 6 mm. This fast moving air generates a spray 74 from the product 30 at a rate of 3 milliliters per second.

The above-described embodiment was dimensioned to generate spray from a product having a particular viscosity. It would be within the knowledge of a person of ordinary skill in the art reading the present disclosure to vary the dimensions and pressure generated to create spray from products having different viscosities. Typically, a more viscous product 30 will require a greater force to push and/or draw the product into the gas stream and a higher speed will be required to create a spray. Also, a product 30 with a greater surface tension will require a similar increase in force and speed. Other properties of the products, such as density and elasticity can also be taken into consideration when determining the dimensions of the particulate sprayer.

In the embodiment shown in FIG. 2, the liquid reservoir 22 and gas reservoir 18 are positioned side-by-side. In alternative embodiments, the liquid reservoir 22 could be positioned above or below the gas reservoir 18. The liquid reservoir 22 could be positioned above the low pressure section 38 such that the product is fed or partially fed into the low pressure section by gravity.

Figure 6:
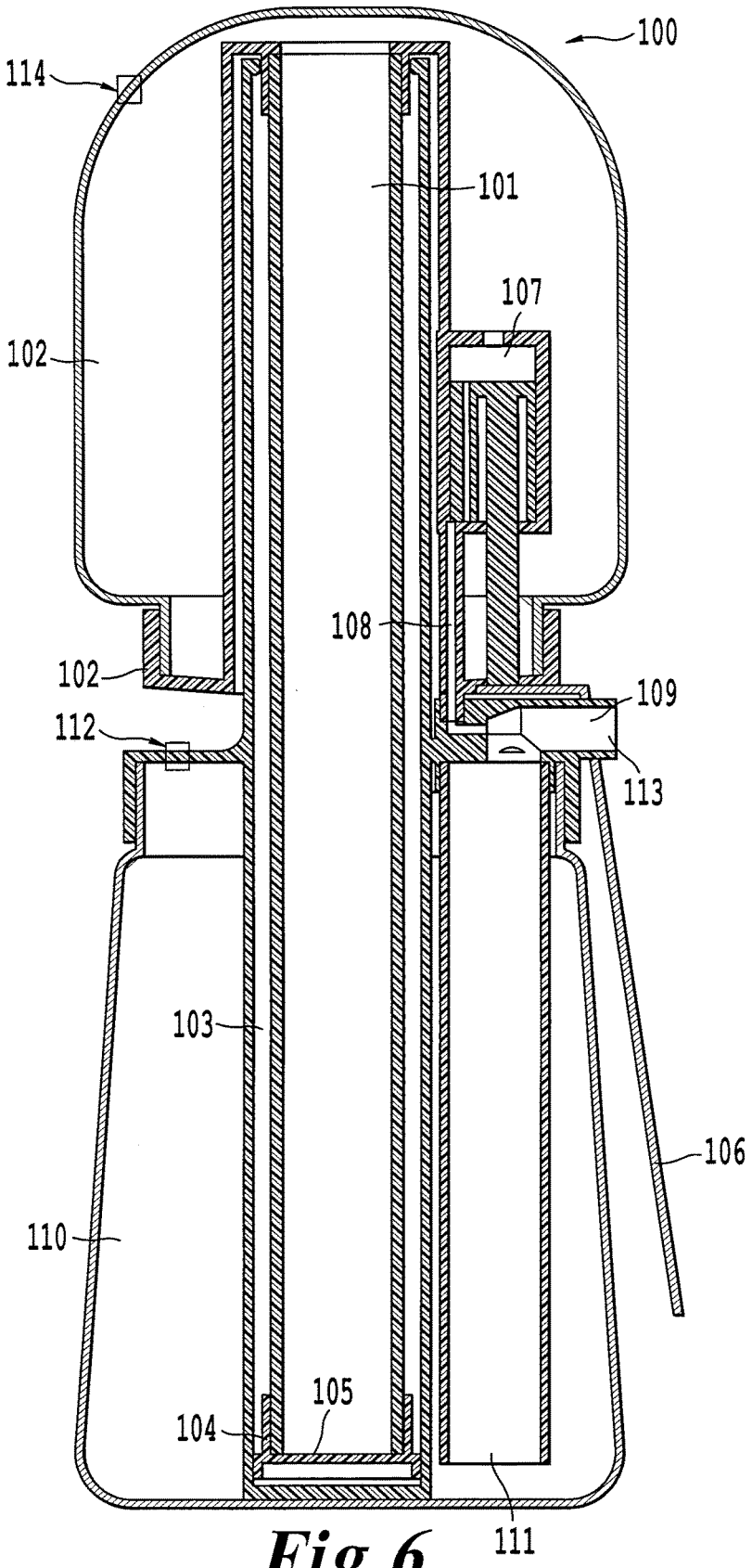
FIG. 6 depicts another exemplary particulate sprayer.

An embodiment in which the gas reservoir is positioned above the liquid reservoir is shown in FIG. 6. The structure and operation of this particulate sprayer 100 will now be described.

To operate the particulate sprayer 100, the air chamber 102 is first pressurized. To pressurize the air chamber, a pump piston 101 is lifted to draw air into the cylinder 103 through a first valve 104 that can be located, for example, at a distal end of the pump piston 101. The pump piston 101 is then pressed back down into the cylinder 103, thereby compressing the air such that the air is forced into the air chamber 102 through a second valve 105. When the pump piston 101 is being pressed back down into the cylinder 103, the first valve 104 prevents the air from escaping around the pump piston 101 and out of the cylinder 103. As the air is forced into the air chamber 102 by the pump piston 101, the pressure in the air chamber 102 increases. A pressure relief valve 114 could be incorporated into the pressurized system to prevent the system becoming over-pressurised and/or to signal by means of an indicator, such as a whistle or flag, that a sufficient pressure has been achieved. This may or may not form part of the third valve 107 or could be a separate system.

Once the air chamber 102 is pressurized, in order to spray the product from the particulate sprayer 100, a button/lever/actuator 106 is activated. By activating the actuator 106, a third valve 107 is opened such that compressed air passes from the air chamber 102 into the third valve 107. From the third valve 107, the compressed air passes through a conduit 108 until it enters a low pressure nozzle 109.

As the air passes through the nozzle 109, the low pressure created causes the product in the product chamber 110 to be sucked up a dip tube 111 where it mixes with the air and the resulting droplets exit the particulate sprayer 100 through an aperture 113. An airway or hole 112 in the product chamber assembly allows air into the product chamber to replace the product being dispensed. The airway or hole may be sealed to prevent the product drying out or spilling when product is not being sprayed.

When the pressure in the air system drops below a predetermined level, for example around 0.5 bar, a spring in the third valve 107 closes the third valve 107, thereby retaining the air that remains upstream of the third valve 107 at a pressure above atmospheric pressure.

Alternatively, if the user releases the actuator 106 before the pressure in the air system drops below the predetermined level, then the air pressure from the air chamber 102 will close the third valve 107, retaining the air for subsequent uses. Again, the air that remains upstream of the third valve 107 is above atmospheric pressure.

The turning off of the air pressure before it drops to atmospheric pressure gives a clean shutoff and prevents dribbling and a low quality spray.

Additionally, the nozzle 109 can include some form of cover or protection to prevent the product in the product chamber 110 and/or the dip tube 111 and/or any product retained in the nozzle 109 from drying out or spilling.

Figure 7A:
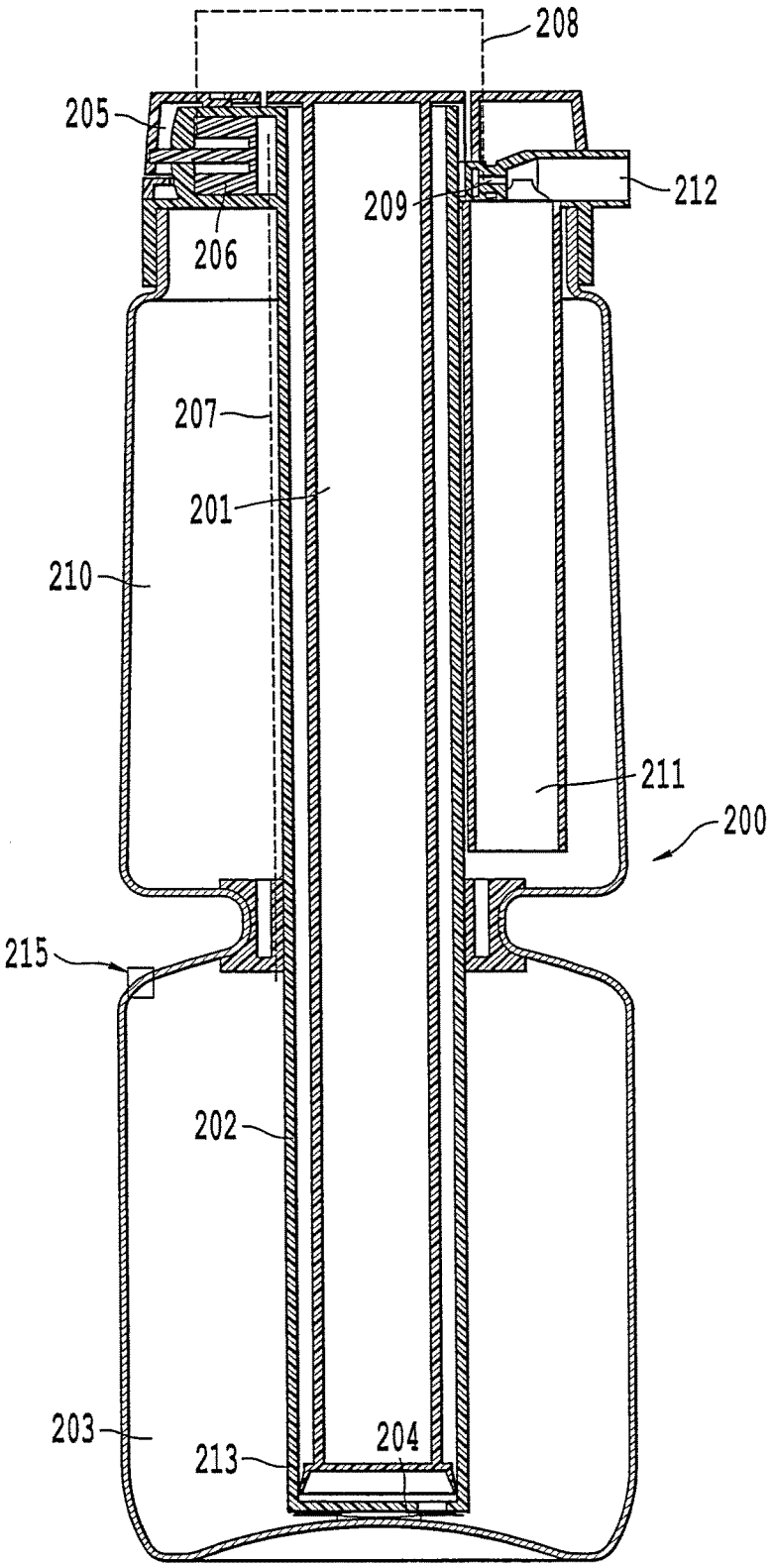
FIGS. 7A, 7B, and 7C depict another exemplary particulate sprayer.
Figure 7B:
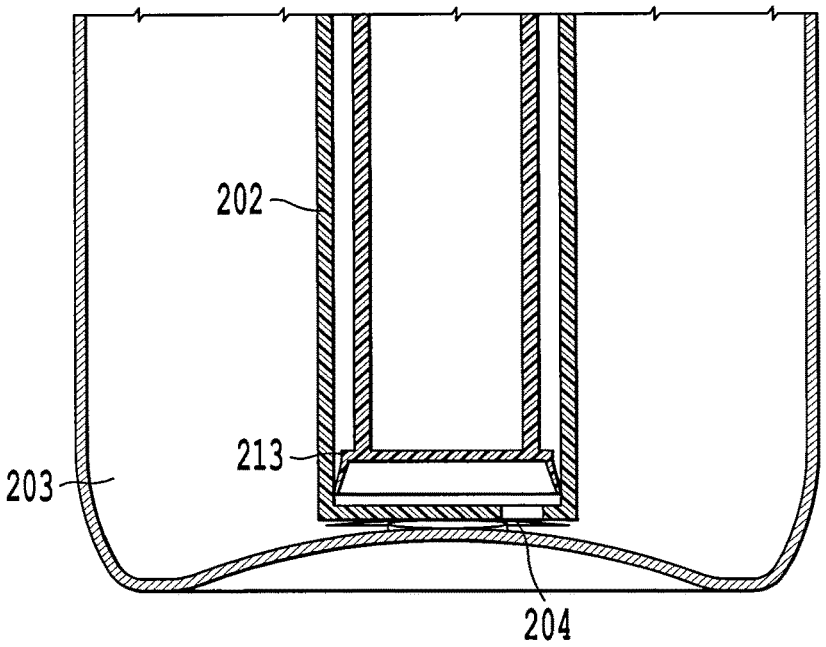
Figure 7C:
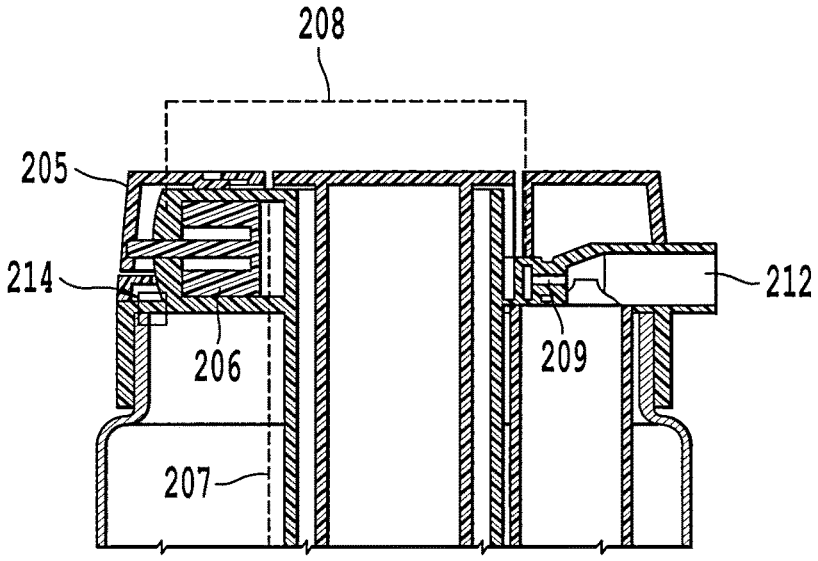

An embodiment in which the gas reservoir is positioned below the liquid reservoir is shown in FIGS. 7A-7C. The structure and operation of this particulate sprayer 200 will now be described.

To operate the particulate sprayer 200, the air chamber 203 is first pressurized. To pressurize the air chamber, a pump piston 201 is lifted such that air is drawn into a cylinder 202 through a first valve 213 that can be located, for example, at a distal end of the pump piston 201. Then, as the pump piston 201 is pressed back down into the cylinder 202, the air is compressed such that it enters the air chamber 203 through a second valve 204 located at the bottom of the cylinder 202, which can be seen more clearly in FIG. 7B. When the pump piston 201 is being pressed back down into the cylinder 202, the first valve 213 prevents the air from escaping around the pump piston 201 and out of the cylinder 202. As air is forced into the air chamber 203 by the pump piston 201, the pressure in the air chamber 203 increases. A pressure relief valve 215 could be incorporated into the pressurized system to prevent the system becoming over-pressurised and/or to signal by means of an indicator, such as a whistle or flag, that a sufficient pressure has been achieved. This may or may not form part of the third valve 206 or could be a separate system.

Once the air chamber 203 is pressurized, in order to spray the product from the particulate sprayer 200, a button/lever/actuator 205 is activated. Activating the actuator 205 opens a third valve 206 to allow compressed air to pass from the air chamber 203 through the pipe 207 (represented as a dotted line in FIGS. 7A and 7C) into the third valve 206. As air exits the third valve 206, it passes through a conduit 208 (also represented as a dotted line in FIGS. 7A and 7C) until it enters a low pressure nozzle 209.

As the air passes through the nozzle 209, the low pressure created causes product 210 to be sucked up a dip tube 211 where it mixes with the air and the resulting droplets exit the particulate sprayer 200 through an aperture 212. An airway or hole 214 in the product chamber assembly allows air into the product chamber to replace the product being dispensed. The airway or hole may be sealed to prevent the product drying out or spilling.

When the pressure in the air system drops below a predetermined level, for example around 0.5 bar, a spring in the third valve 206 closes the valve 206. By closing the third valve 206, the air that is retained upstream of the third valve 206 is above atmospheric pressure.

Alternatively, if the user releases the actuator 205, the air pressure from the air chamber 203 will close the third valve 206. Again, the air that remains upstream of the third valve 206 is above atmospheric pressure.

The turning off of the air pressure before it drops to atmospheric pressure gives a clean shutoff and prevents dribbling and a low quality spray.

Additionally, the nozzle 209 can include some form of cover or protection to prevent the product in the product chamber 110 and/or the dip tube 111 and/or any product retained in the nozzle 209 from drying out or spilling.

In an alternative embodiment, the liquid reservoir 22 could surround or be surrounded by the gas reservoir 18.

In another alternative embodiment, either of the low pressure nozzles 109/209 described above could be configured such that it forms an interchangeable component within the device to allow products of differing viscosity and/or particle size/concentration to be sprayed. The dip-tube 111/211 and pathway 46 may also be required to become interchangeable depending on the range of products the system is being designed to work with. Other elements of the system may need to be sized to allow a range of products to be sprayed from a single device with interchangeable parts.

In a further embodiment, a gas pressure regulator could be introduced into the first pathway 46 such that it is the regulator that controls pressure reaching the low pressure nozzle 109/209 rather than the pressure being controlled by the diameter of the pathway. The regulator is a non-relieving pressure regulator that restricts the gas flow rather than venting any over-pressure to atmosphere. In so doing the regulator delivers all the gas available from the reservoir while maintaining a defined upper output pressure. The regulator matches the flow of gas to the demand for gas placed upon the system. If the demand for flow increases, then the regulator flow increases in order to keep the required pressure from decreasing due to a shortage of gas in the system. If the demand flow decreases, then the regulator flow decreases also, keeping the required pressure from increasing due to an excess of gas in the system.

Figure 8:
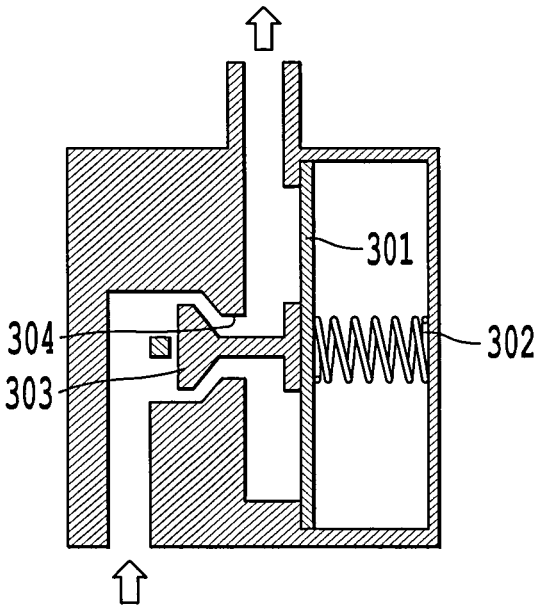
FIG. 8 depicts an exemplary gas pressure regulator.

FIG. 8 depicts an exemplary embodiment of the regulator. The regulator restricts flow when the pressure in the pathway upstream of the nozzle is above that required, because the pressure acts on a diaphragm 301 forcing it up against a loading element 302 (such as, but not restricted to, a coil or rubber spring, weight, or piston actuator). Attached to the diaphragm or as part of the diaphragm is a valve restricting element 303, which is drawn up with the diaphragm and restricts the passing gas flowing through the valve 304. The restricting element 303, which is attached to or as part of the diaphragm 301, could be a poppet valve or any other type of valve that is capable of operating as a variable restriction to the flow.

In other embodiments, this regulator might be placed in other positions within the air circuit such as the outlet from the air chamber 203 or combined with the third valve 107/206 and the first pathway 46 altered such that it does not regulate the pressure.

Pulses of air from the air chamber 110/203 can be used to extend the duration of the spray while helping to control the volume of product being dispensed. This could be achieved by introducing a pulsing valve within the air circuit or combining this function with one of the other valves such as the third valve 107/206. In doing so the air reaching the low pressure nozzle 109/209 is pulsed such that pulses of product exit the unit. This pulsing has the effect of maintaining the characteristics of the spray (length and angle) while reducing the volume of air required to extend the spraying of a given volume of product from the particulate sprayer 100/200 through an aperture 113/212 over time. Multiple nozzles and corresponding overlapping pulses could feed the product through separate pathways to separate apertures to reduce the apparent stop-start appearance of the spray.

The sprayer could be constructed from plastic and/or metal and/or glass parts.

In an exemplary embodiment, the product 30 is a food product, as shown in FIG. 2. For example, the liquid can be a marinade, barbeque sauce, olive oil, etc., and the particulate is a solid food, such as pieces of garlic, onion, pepper, etc., to impart flavor. The solid food is preferably chopped into pieces having a length of up to and including 2 mm for a particulate sprayer with a 6 mm outlet aperture. However, particulates having a length of above 2 mm can be used with a particulate sprayer that has an appropriately sized outlet.

The product 30 is not limited to use with food. For example, the particulate sprayer could spray a lawn care product, such as liquid and solid fertilizer. The particulate sprayer could also be used with a product for painting or other uses where it is desirable to spray a liquid and solid together, for example to spray medication onto or into the body.

Obviously, numerous modifications and variations of the exemplary embodiments described herein are possible in light of the above teachings. It is therefore to be understood that within the scope of the appended claims, the embodiments may be practiced otherwise than as specifically described herein.

The invention claimed is:

1. A hand-held food particulate sprayer, comprising:

a gas reservoir being of fixed volume and containing a gas in a gas state;

a liquid reservoir being of fixed volume and positioned entirely above the gas reservoir;

a cylinder or tube extending into each of the gas reservoir and the liquid reservoir;

a valve disposed within the gas reservoir and allowing the gas to enter into the reservoir, said valve being arranged closer to a bottom of the liquid reservoir than to a top of the liquid reservoir;

the liquid reservoir containing a food product in a liquid state that includes a liquid and solid food particles;

a low pressure section connected to the gas reservoir and having a reduced diameter section;

the reduced diameter section being located above the liquid reservoir; and a dip tube connecting the liquid reservoir to an exit opening, wherein the gas released from the gas reservoir enters the low pressure section and then travels over the exit opening to draw the food product through the dip tube and into the exit opening to create a mixture of the gas and the food product to be sprayed from the particulate sprayer.

2. The particulate sprayer of claim 1, further comprising a pump configured to increase a pressure in the gas reservoir.

3. The particulate sprayer of claim 1, wherein the gas in the gas reservoir is in a pressurized gas in the gas state.

4. The particulate sprayer of claim 1, further comprising a valve for releasing the gas from the gas reservoir.

5. The particulate sprayer of claim 1, wherein the valve comprises a one-way valve.

6. The particulate sprayer of claim 1, further comprising a one-way valve that when opened, allows a portion of the gas released from the gas reservoir to enter the liquid reservoir through the one-way valve to push the product through the exit opening.

7. The particulate sprayer of claim 1, further comprising a valve configured to open when a pressure in the low pressure section increases to a predetermined amount, and wherein, when the valve is opened, a portion of the gas released from the gas reservoir enters the liquid reservoir through the valve to maintain a height of the product in the dip tube.

8. The particulate sprayer of claim 1, wherein the solid particles have a length of up to and including 2 mm.

9. The particulate sprayer of claim 1, wherein the sprayed mixture is not filtered between the exit opening and an outside of the particulate sprayer.

10. The particulate sprayer of claim 1, further comprising:

a pipe connecting the gas reservoir to the low pressure section, wherein the gas released from the gas reservoir enters the low pressure section via the pipe and then travels over the exit opening.

11. The particulate sprayer of claim 1, wherein the gas reservoir has a volume of 250 to 500 ml.

12. The particulate sprayer of claim 1, wherein the liquid reservoir has a volume of 250 to 500 ml.

13. A band-held food particulate sprayer, comprising:

a spray opening;

a gas reservoir containing a gas in a gas state;

a liquid reservoir positioned entirely above the gas reservoir;

a pump cylinder extending into the gas reservoir and the liquid reservoir;

a pump piston disposed inside the pump cylinder;

the liquid reservoir containing a food product in a liquid state that includes a liquid and solid food particles;

a valve disposed within the gas reservoir and allowing the gas to enter into the gas reservoir, said valve being arranged closer to a bottom of the liquid reservoir than to a top of the liquid reservoir;

a low pressure section connected to the gas reservoir;

the low pressure section being located above the liquid reservoir;

a dip tube connecting the liquid reservoir to an exit opening; and the exit opening being located between the low pressure section and the spray opening, wherein the gas released from the gas reservoir enters the low pressure section and then travels over the exit opening to draw the food product through the dip tube and into the exit opening to create a mixture of the gas and the food product to be sprayed from the spray opening.

14. A hand-held food particulate sprayer, comprising:

a spray opening;

a sprayer housing containing therein a gas reservoir and a liquid reservoir;

the gas reservoir being of fixed volume and containing a gas in a pressurized gas state;

the liquid reservoir being of fixed volume and positioned entirely above the gas reservoir;

a pump cylinder disposed inside the sprayer housing and extending into the gas reservoir and the liquid reservoir;

a pump piston disposed inside the pump cylinder;

a valve disposed within the gas reservoir and allowing the gas to enter into the gas reservoir, said valve being arranged closer to a bottom of the liquid reservoir than to a top of the liquid reservoir;

the liquid reservoir containing a food product in a liquid state that includes a liquid and suspended food particles;

a gas flow passage connecting the gas reservoir to a passage section sized to increase gas flow;

a dip tube connecting the liquid reservoir to an exit opening; and the exit opening being located between the passage section and the spray opening, wherein the gas released from the gas reservoir enters the passage section and then travels over the exit opening thereby creating a pressure drop that draws the product through the dip tube and into the exit opening to create a mixture of the gas and the food product to be sprayed from the spray opening.

15. The particulate sprayer of claim 1, wherein the cylinder or tube is a centrally disposed.

16. The particulate sprayer of claim 1, wherein the cylinder or tube is a pump cylinder.

17. The particulate sprayer of claim 16, further comprising:

a pump piston disposed inside the pump cylinder.

18. The particulate sprayer of claim 13, wherein the spray opening is arranged above the gas reservoir and the liquid reservoir.

* * * * *